US008496189B2

(12) United States Patent
Lomond et al.

(10) Patent No.: US 8,496,189 B2
(45) Date of Patent: Jul. 30, 2013

(54) METHODOLOGY FOR IMPROVED MIXING OF A SOLID-LIQUID SLURRY

(75) Inventors: Perry D. Lomond, Houston, TX (US); Mukesh Kapila, The Woodlands, TX (US)

(73) Assignee: M-I L.L.C., Houston, TX (US)

( * ) Notice: Subject to any disclaimer, the term of this patent is extended or adjusted under 35 U.S.C. 154(b) by 1644 days.

(21) Appl. No.: 11/690,025

(22) Filed: Mar. 22, 2007

(65) Prior Publication Data

US 2007/0237026 A1 Oct. 11, 2007

Related U.S. Application Data

(63) Continuation-in-part of application No. 11/020,891, filed on Dec. 22, 2004, now Pat. No. 7,311,270.

(60) Provisional application No. 60/532,159, filed on Dec. 23, 2003.

(51) Int. Cl.
*B05B 7/30* (2006.01)

(52) U.S. Cl.
USPC ..... 239/344; 239/434

(58) Field of Classification Search
USPC ..... 239/398, 399, 403, 406, 426, 342, 239/344, 354, 361, 379, 434, 589
See application file for complete search history.

(56) References Cited

U.S. PATENT DOCUMENTS 1,972,955 A * 9/1934 Saugman ..... 417/181
2,543,294 A * 2/1951 McCabe ..... 239/318
3,191,869 A * 6/1965 Gilmour ..... 239/318
3,231,200 A * 1/1966 Heald ..... 239/318
3,892,359 A * 7/1975 Dwyer et al. ..... 239/342
3,936,382 A 2/1976 White
4,519,423 A 5/1985 Ho et al.
4,533,123 A 8/1985 O'Leary
4,590,057 A 5/1986 Hicks
4,688,945 A 8/1987 Brazelton et al.
4,705,405 A 11/1987 Williams
4,838,701 A 6/1989 Smith et al.
4,860,959 A 8/1989 Handleman
5,171,090 A 12/1992 Wiemers
5,407,299 A 4/1995 Sutton
5,544,951 A 8/1996 Alack
5,664,733 A 9/1997 Lott
5,799,831 A 9/1998 Spriggs et al.
5,839,474 A 11/1998 Greaney
(Continued)

*Primary Examiner* — Davis Hwu
(74) *Attorney, Agent, or Firm* — Andrea Tran; David J. Smith

(57) ABSTRACT

Disclosed herein is a mixing apparatus for mixing solids and liquids comprising a mixing chamber defined within a plurality of sides radially arranged about a central axis, the mixing chamber comprising an eductor, the eductor comprising a first chamber inlet separated along the central axis from a chamber outlet by a frusta conical venturi throat arranged coaxial with a central axis; the eductor further comprising a second chamber inlet disposed through one or more of the plurality of sides and located between the first chamber inlet and the chamber outlet, the second chamber inlet having a plurality of second inlet opening diameters, each determined perpendicular to the central axis at the point at which the second chamber inlet intersects with an outer wall of the venturi throat, wherein the second inlet diameters are each less than the diameter of the venturi throat at each of the points at which the second chamber inlet intersects with the outer wall of the venturi throat. A method of mixing solids with a liquid is also disclosed.

20 Claims, 4 Drawing Sheets

U.S. PATENT DOCUMENTS

| | | | |
|---|---|---|---|
| 5,927,338 | A | 7/1999 | Boticki et al. |
| 6,000,839 | A | 12/1999 | Lott |
| 6,131,601 | A | 10/2000 | Schiller et al. |
| 6,238,081 | B1 | 5/2001 | Sand |
| 6,254,267 | B1 | 7/2001 | Arnaud |
| 6,279,598 | B1 | 8/2001 | Boticki et al. |
| 6,328,226 | B1 | 12/2001 | Goenka et al. |
| 6,402,068 | B1 | 6/2002 | Handleman |
| 6,425,529 | B1 | 7/2002 | Reinsch et al. |
| 6,450,374 | B1 | 9/2002 | Lohr |
| 6,464,210 | B1 | 10/2002 | Teran et al. |
| 6,499,872 | B2 | 12/2002 | Sand |
| 6,588,466 | B1 | 7/2003 | Lohr |
| 6,634,376 | B2 | 10/2003 | Haas |
| 6,655,401 | B2 | 12/2003 | Sand et al. |
| 6,715,701 | B1 | 4/2004 | Julien |
| 6,749,330 | B2 | 6/2004 | Allen |
| 6,766,831 | B2 | 7/2004 | Oliver |
| 6,796,704 | B1 | 9/2004 | Lott |
| 6,877,890 | B2 | 4/2005 | Whiteley |
| 6,901,929 | B2 | 6/2005 | Burr et al. |
| 6,951,312 | B2 | 10/2005 | Casalmir et al. |
| 6,966,688 | B2 | 11/2005 | Lins |
| 6,974,546 | B2 | 12/2005 | Wood |

* cited by examiner

METHODOLOGY FOR IMPROVED MIXING OF A SOLID-LIQUID SLURRY

RELATED APPLICATION

This application is a continuation in part of U.S. patent application Ser. No. 11/020,891, filed Dec. 22, 2004 now U.S. Pat. No. 7,311,270, which claims priority to U.S. Provisional application 60/532,159 filed on Dec. 23, 2003, entitled "Device and Methodology for Improving Liquid/Solid Mixing," all of which are hereby incorporated by reference.

BACKGROUND OF THE INVENTION

Efficient mixing of fluids and solids is essential for many industry sectors.

The means by which this mixing is undertaken are many, the choice of which is dependent upon the nature of the materials being mixed and the degree and rate of mixing required.

Numerous concepts and frequent efforts have been made to improve the efficiency and effectiveness of liquid and solid mixing systems. Systems typically include a motive force, e.g., a liquid stream, into which solids are added. Several notable methods that have met with relative success, depending upon the nature of the materials being mixed, have included: nozzle geometry distortion, motive flow pulsation, and the introduction of a diffuser as part of the system.

However, as shown in Comparative FIG. 1, when solids are introduced into the motive liquid stream using gravity by directing the solids into a larger cavity containing the liquid jet stream, only a small portion of the solids make contact with the liquid. As a result, the motive force may tend to "carve" a channel through the solids further limiting the amount of solids which come into contact with the liquid stream. As additional solids are added, the solids present may build up around the liquid stream such that the inlet to the mixing chamber becomes blocked or plugged by the solids.

The use of an eductor to create a vacuum to induce solids into the motive fluid improves the entrainment of the solids into the liquid. However, an eductor does not overcome all the issues associated with the limited amount of solids which contact the liquid steam. Accordingly, there is a need in the art for mixing chambers that more effectively bring added solids into contact with the motive liquid stream.

SUMMARY OF THE INVENTION

In a first aspect, of the present invention, a mixing apparatus for mixing solids and liquids includes a mixing chamber defined within a plurality of sides radially arranged about a central axis, the mixing chamber comprising an eductor, the eductor comprising a first chamber inlet separated along the central axis from a chamber outlet by a frusta conical venturi throat arranged coaxial with the central axis, wherein the diameter of the venturi throat increases from the first chamber inlet to the chamber outlet, the first chamber inlet radially arranged about the central axis and having an inlet diameter, the chamber outlet radially arranged about the central axis and having an outlet diameter which is greater than the inlet diameter, the eductor further comprising a second chamber inlet disposed through an outer wall of the venturi throat, and located between the first chamber inlet and the chamber outlet, the second chamber inlet being in fluid communication with the first chamber inlet and the chamber outlet, the second chamber inlet radially arranged about a second chamber inlet axis oriented perpendicular to the central axis, the second chamber inlet having a plurality of second inlet opening diameters, each determined perpendicular to the central axis at the point at which the second chamber inlet intersects with an outer wall of the venturi throat, wherein the second inlet diameters are each less than the diameter of the venturi throat at each of the points at which the second chamber inlet intersects with the outer wall of the venturi throat.

In another aspect of the present invention, a method of mixing a solid and a liquid comprises the steps of introducing the liquid as a motive fluid into a first chamber inlet of a mixing apparatus, and introducing the solid into a second chamber inlet of the mixing apparatus, and contacting the solid with the liquid to produce a mixture of the solids and the liquid, the mixing apparatus includes, a mixing chamber defined within a plurality of sides radially arranged about a central axis, the mixing chamber comprising an eductor, the eductor comprising the first chamber inlet separated along the central axis from a chamber outlet by a frusta conical venturi throat arranged coaxial with a central axis, wherein the diameter of the venturi throat increases from the first chamber inlet to the chamber outlet, the first chamber inlet radially arranged about the central axis and having an inlet diameter, the chamber outlet radially arranged about the central axis and having an outlet diameter which is greater than the inlet diameter, the eductor further comprising a second chamber inlet disposed through an outer wall of the venturi throat, and located between the first chamber inlet and the chamber outlet, the second chamber inlet being in fluid communication with the first chamber inlet and the chamber outlet, the second chamber inlet radially arranged about a second chamber inlet axis oriented perpendicular to the central axis, the second chamber inlet having a plurality of second inlet opening diameters, each determined perpendicular to the central axis at the point at which the second chamber inlet intersects with an outer wall of the venturi throat, wherein the second inlet diameters are each less than the diameter of the venturi throat at each of the points at which the second chamber inlet intersects with the outer wall of the venturi throat.

Other aspects and advantages of the claimed subject matter will be apparent from the following description and the appended claims.

BRIEF DESCRIPTION OF THE DRAWINGS

Comparative

DETAILED DESCRIPTION

The claimed subject matter relates to a mixing chamber, an apparatus for mixing solids and liquids comprising the mixing chamber, and a method for mixing liquids with solids.

Figure 1:
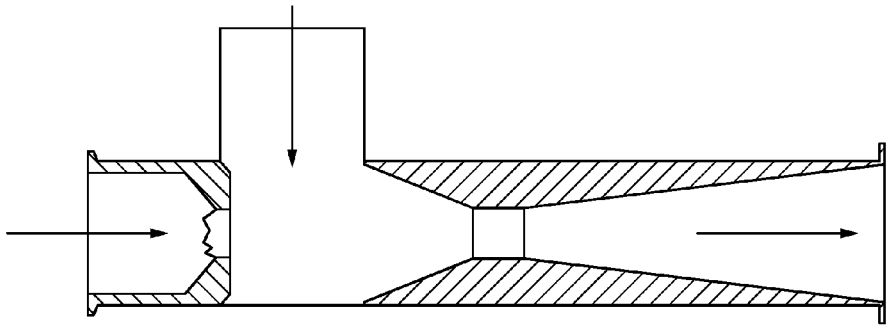
FIG. 1 (Prior Art)
FIG. 1 shows a schematic view of a prior art mixing apparatus.
Figure 2:
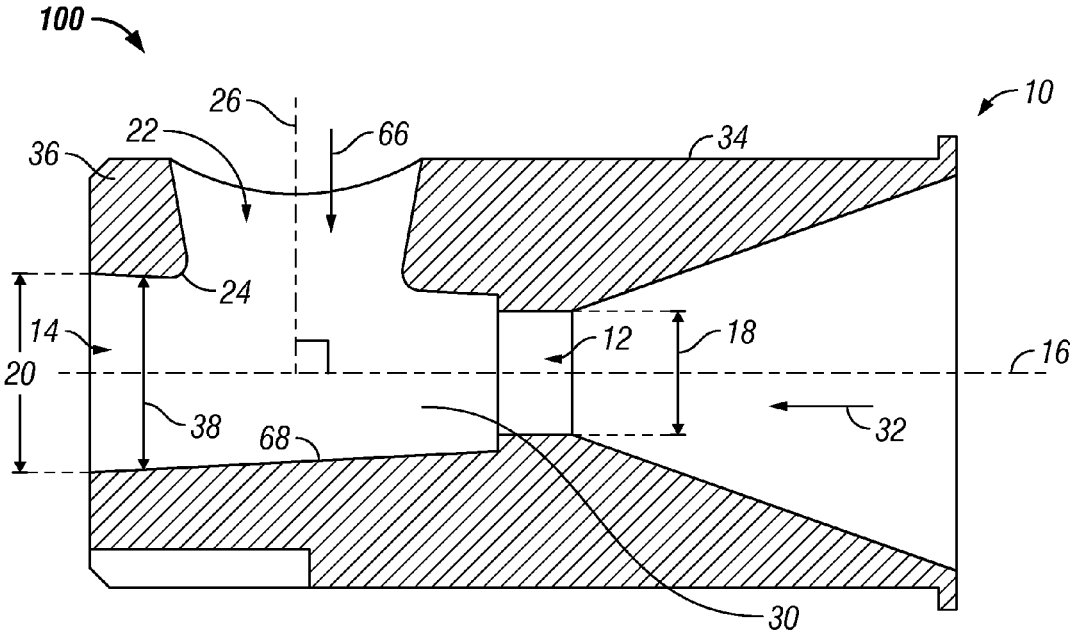
FIG. 2 shows a schematic view of a mixing chamber of the instant mixing apparatus.
Figure 3:
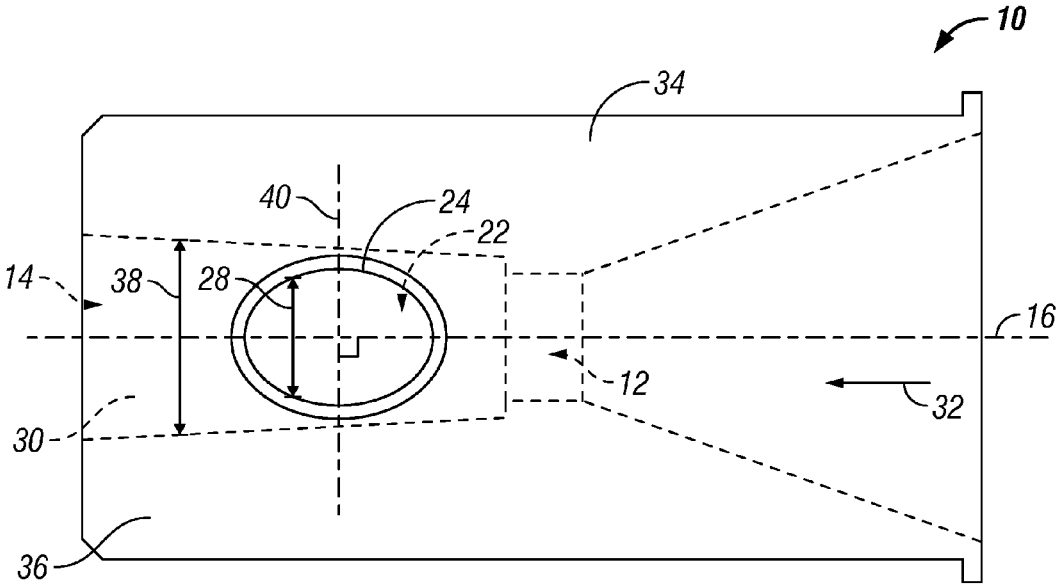
FIG. 3 shows an overhead cut-away view of the mixing chamber of FIG. 2.

The mixing apparatus described herein provides for an improvement in the contacting of solids with a motive liquid stream. Turning to the embodiment shown in FIG. 2, the instant mixing apparatus for mixing solids and liquids comprises a mixing chamber, generally referred to by 10, which is defined within a plurality of sides 34 radially arranged about a central axis 16. Mixing chamber 10 may comprise an eductor 36 comprising a first chamber inlet 12 separated along central axis 16 from a chamber outlet 14 by a frusta conical venturi throat 30 arranged coaxial with central axis 16, wherein the venturi diameter 38 of venturi throat 30, determined through a line extending from an outer wall 68 of venturi throat 30 through central axis 16 to the outer wall 68 of venturi throat 30, increases from first chamber inlet 12 to chamber outlet 14. Preferably, venturi diameter 38 increases uniformly from first chamber inlet 12 to chamber outlet 14. First chamber inlet 12 is radially arranged about central axis 16 and has an inlet diameter 18. Chamber outlet 14 is radially arranged about central axis 16 and has an outlet diameter 20, which is greater than inlet diameter 18. Eductor 36 may further comprise a second chamber inlet 22 disposed through one or more of the plurality of sides 34, and is located between first chamber inlet 12 and chamber outlet 14. Solids and/or other solute 66 may be added to second chamber inlet 22 to be brought into contact with a motive fluid stream 32 traveling from chamber inlet 12 to chamber outlet 14. Second chamber inlet 22 comprises a second chamber opening 24 radially arranged about a second chamber inlet axis 26 oriented perpendicular to central axis 16. As shown in FIG. 3, depicting a top-side cut-away view of mixing chamber 10 along second chamber inlet axis 26, second chamber inlet 22 has a plurality of second inlet opening diameters 28 (only one of which is shown for clarity), each determined along second chamber inlet diameter axis 40, which is oriented perpendicular to central axis 16 at the point at which the second chamber opening 24 intersects with venturi throat 30. The second inlet diameters 28 are each less than the diameter of the venturi throat 38 at each of the points at which second chamber opening 24 intersects with venturi throat 30. Applicants have unexpectedly discovered that by limiting the second inlet opening diameter 28 to less than the corresponding venturi throat diameter 38, the instant mixing chamber ensures that all of the solids and other materials 66 which enter through second chamber inlet 22 are contacted by the motive fluid stream 32 flowing from first chamber inlet 12 to chamber outlet 14.

Figure 4:
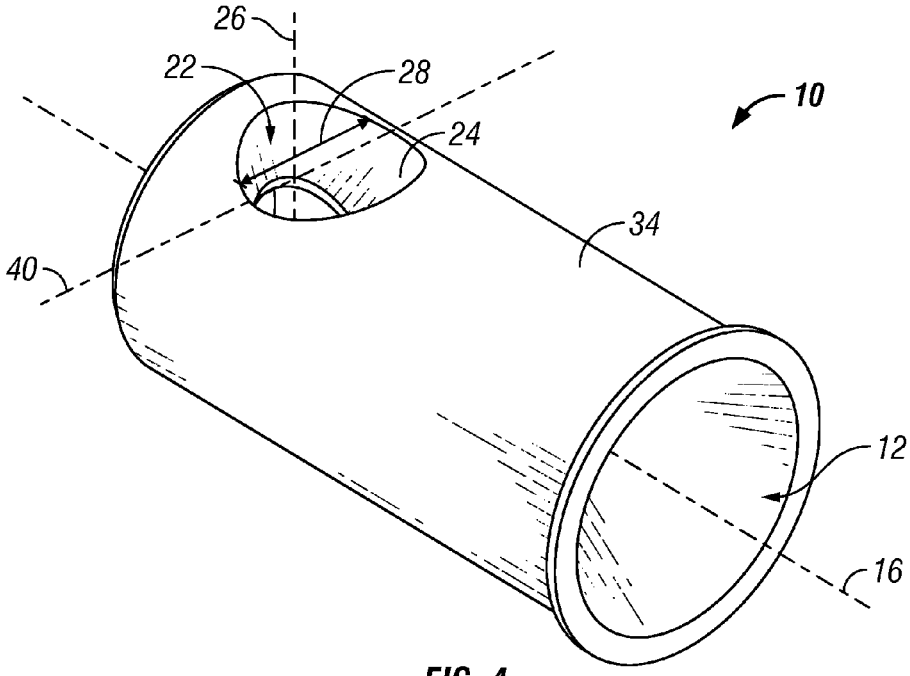
FIG. 4 shows a perspective view of the mixing chamber of FIG. 2.

As shown in FIG. 4, which depicts a perspective view of the instant mixing chamber 10, in a preferred embodiment, mixing chamber 10 comprises a second chamber inlet 22 having a frustraconical second chamber opening 24 aligned coaxial with second chamber inlet axis 26, wherein the second inlet opening diameter 28 of the second chamber opening 24 increases along chamber inlet axis 26 in a direction away from central axis 16.

Figure 5:
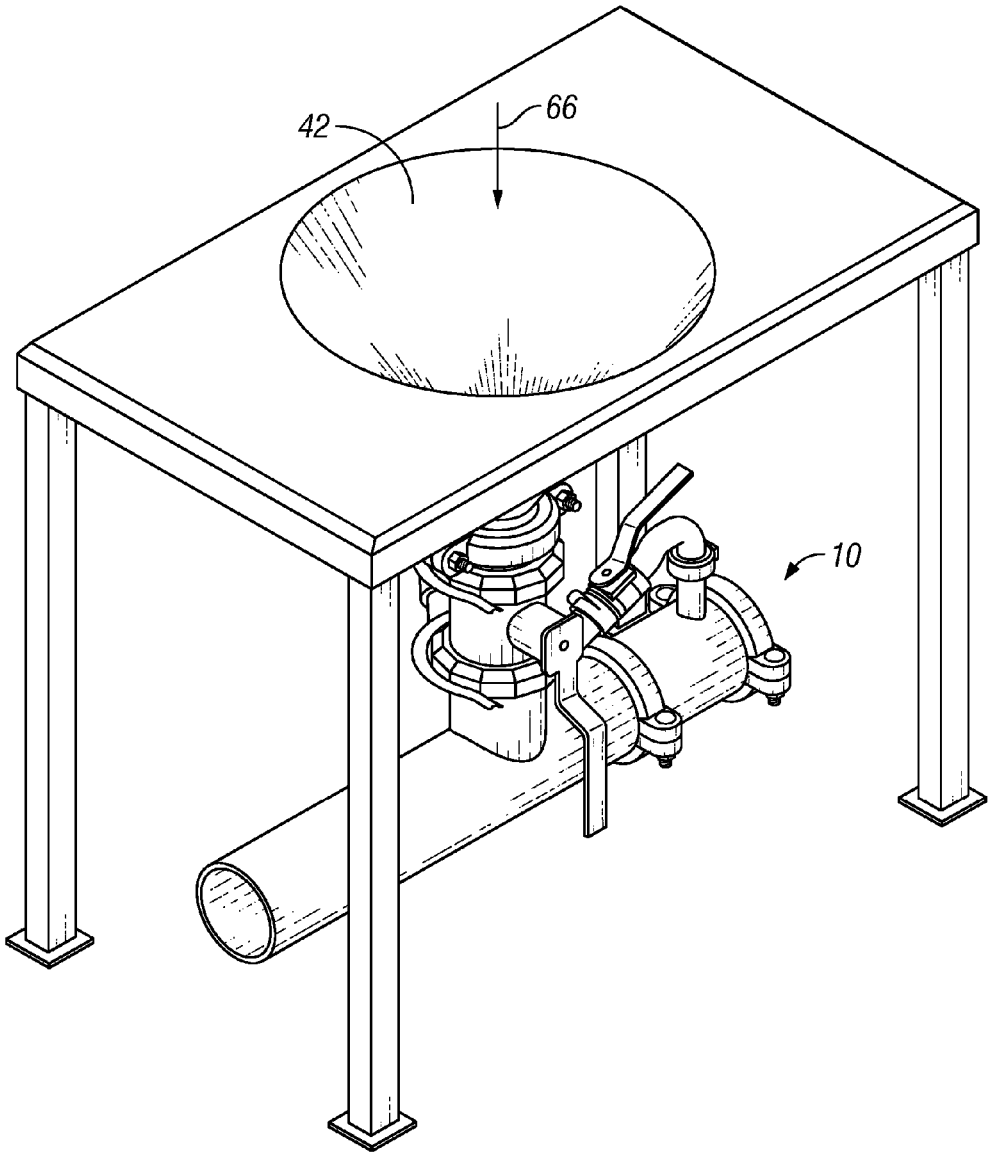
FIG. 5 shows an embodiment of the instant mixing apparatus in combination with a hopper table.

As shown in FIG. 5, the mixing apparatus described herein may further comprise a hopper 42 operable to provide the plurality of solid particles and/or other solute 66 to be mixed with motive fluid stream 32, to mixing chamber 10 through second chamber inlet 22.

Figure 6:
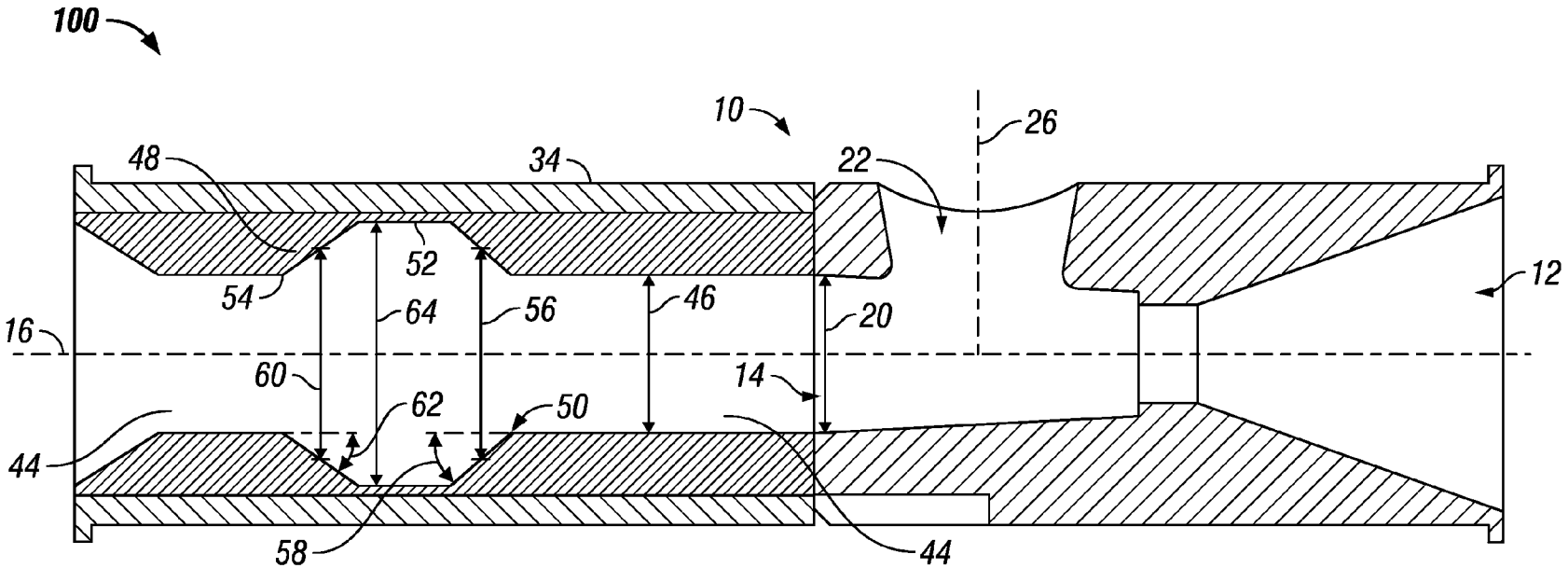
FIG. 6 shows a schematic view of and embodiment of the instant mixing apparatus.

As shown in FIG. 6, the instant mixing apparatus, generally referred to as 100, may further comprise one or more of a turbulence chamber 44 coaxially arranged about central axis 16, wherein turbulence chamber 44 is in fluid communication with, and downstream from chamber outlet 14. The turbulence chamber diameter 46 is preferably equal to outlet diameter 20. Turbulence chamber 44 preferably has a circular cross-sectional area as determined perpendicular to central axis 16.

Mixing apparatus 100 may further comprise one or more of a diffuser 48, preferably wherein turbulence chamber 44 is located between, and in fluid communication with chamber outlet 14 and diffuser 48.

Diffuser 38 is preferably radially arranged about, and coaxial with central axis 16, wherein the diffuser is in fluid communication with the chamber outlet. Diffuser 48 preferably comprises a diffuser inlet 50 in fluid communication with a diffuser throat 52, which is in turn in fluid communication with a diffuser outlet 54. Diffuser 48 preferably comprises a circular cross-section as determined perpendicular to central axis 16.

Diffuser inlet 50 preferably comprises a frustraconical opening coaxial with central axis 16, wherein the diffuser inlet diameter 56 preferably increases continuously along central axis 16 in a direction toward diffuser throat 52 at a rate proportional to a diffuser inlet angle 58 determined relative to a line parallel to central axis 16.

Diffuser throat 52 preferably has a circular cross-section determined perpendicular to central axis 16 and preferably has a constant diffuser throat diameter 64 from diffuser inlet 50 to diffuser outlet 54.

Diffuser outlet 54 preferably comprises a frustraconical opening coaxial with central axis 16, wherein a diffuser outlet diameter 60 decreases continuously along central axis 16 in a direction away from diffuser throat 52 at a rate proportional to a diffuser outlet angle 62 determined relative to a line parallel to central axis 16.

In a preferred embodiment, diffuser inlet angle 58 is less than diffuser outlet angle 62. In another preferred embodiment, diffuser inlet diameter 56 is greater than diffuser outlet diameter 60. While the instant mixing apparatus is depicted in the figures with one mixing chamber followed by a turbulence chamber, which is followed by a single diffuser, it is to be understood that the instant mixing apparatus may comprise a plurality of mixing chambers, turbulence chambers, and/or diffusers depending on the solids and/or liquids to be mixed, the motive fluid, and the mixing requirements.

Chamber inlet diameter 18, outlet diameter 18, second inlet opening diameter 28, venturi diameter 38, turbulence chamber diameter 46, diffuser inlet diameter 56, diffuser outlet diameter 58, and/or diffuser throat diameter are each, when applicable, dimensioned and arranged such that when motive fluid stream 32 flows there-through, a partial vacuum is created by this motive flow at second chamber inlet 22 as a result of pressure variations within motive fluid stream 32.

The instant mixing apparatus results in improved in-line liquid/solid mixing. The elements of the instant mixing apparatus provide improved fluid mixing that achieves: acceleration of the motive fluid; provides improved mixing of fluids and secondary solids 66; utilizes a unique second chamber inlet geometry and placement, which improves the vacuum in the void between chamber outlet 14 and diffuser inlet 50. The end result is an improvement in the rate of induction of solids or other solute 66 into motive fluid stream 32. Utilization of instant diffuser 48 with non-uniform diffuser inlet angles 58 relative to diffuser outlet angles 62 results in improved mixing and incorporation of the solids 66 into the motive fluid stream 32. The turbulence chamber 44 and the diffuser 48 are each dimensioned and arranged to induces macro and micro vortices in the motive flow of motive fluid stream 32, which improves mixing, the rate of hydration of solids; increases motive flow rates through the apparatus, and permits consistent performance with low or inconsistent line pressure of motive fluid stream 32.

The instant mixing apparatus may be constructed of any material rigid enough to maintain the appropriate dimensions under operational conditions. In a preferred embodiment, the instant mixing apparatus is comprised of a polymeric resin, preferably a thermoset resin. In a preferred embodiment, the instant mixing apparatus is comprised of polyurethane resin having a Shore D hardness of greater than or equal to about 50, preferably greater than or equal to about 60, with greater than or equal to about 70 being more preferred.

In an embodiment, the mixing chamber 10 is a separate piece dimensioned and arranged to couple with the turbulence chamber and/or the diffuser, which in turn may be separate pieces or may be the contained within a single piece. The instant mixing apparatus may be produced by machining of stock, and/or other practices known in the art. However, the ability to produce this instant mixing apparatus from a thermoplastic or a thermoset resin allows for the flexibility of producing all or some of the pieces of the instant mixing apparatus using injection molding or other similar molding techniques.

When the instant mixing apparatus 100 is used as part of a method for liquid/solid mixing, the liquid fluid (motive fluid stream 32), acting as a motive flow passes through first chamber inlet 12 into the void of venturi throat 30, creating a temporary vacuum at second chamber inlet 22, which permits the enhanced induction of solids to be entrained into the motive flow external to eductor 36. By limiting the second inlet opening diameter to be less than the corresponding venturi diameter, all the solids entering through second chamber inlet 22 must be contacted with motive fluid stream 32. As such, no solids 66 are bypassed by the motive flow and thus solids 66 do not block, bridge, or otherwise inhibit the flow of solids 66 into the motive fluid stream 32.

The instant apparatus is ideally suited for the production of a mixture of a plurality of solid materials and a liquid which is suitable for use as a drilling mud or as a component in a drilling mud. The solid particles may include a variety of powdered and/or particulate materials as are known t those of skill in the art. Examples of suitable solids include bentonite clays, polyanionic cellulose, and various polymers. The motive fluid stream 32 preferably comprises water, but may comprise organic solvents, pH additives, surfactants, solubility aids, and/or other additives and fluids known to those of skill in the art.

A method of mixing solid particles with a motive flow includes the steps of introducing a motive fluid stream 32 into mixing chamber 10 through first chamber inlet 12 at a pressure and at a flow rate such that a vacuum (e.g., a negative pressure relative to an ambient pressure) is created at second chamber inlet 22 by the motive flow. A plurality of solid particles are introduced into mixing chamber 10 at second chamber inlet 22, and may be induced into the motive fluid by the vacuum that has been created, by gravity (e.g., the gravitational pull on a column of the solids themselves), and/or by application of an external pressure on the solids directing them into second chamber inlet 22. Upon entering turbulence chamber 44, a region of turbulence is provided to mix the motive flow and the induced solids. The motive flow, now carrying the induced solids may further be diffused in one or more diffusers 48 to further entrain and otherwise mix the solid particles within the motive fluid flow. In an embodiment comprising a plurality of turbulence chambers 44 and/or a plurality of diffusers 48, the mixture of solids and the motive flow may, prior to each diffusion, be subjected to an increased flow rate by reducing the cross sectional area through which the mixture flows.

In applications involving the production of drilling mud and/or other slurry type fluids useful in oil-field operations, the inlet diameter 18 is preferably about 2 cm or greater, more preferably about 3 cm or greater, with about 4 cm or greater being more preferred. Likewise, the outlet diameter 20 is preferably about 4.5 cm or greater, more preferably about 5 cm or greater, with about 6 cm or greater being more preferred. Flow rates of motive fluid stream 32 are preferably 100 liters per minute (1 pm) or greater, more preferably greater than or equal to about 500 lpm, with greater then or equal to about 1000 lpm being more preferred. The rate at which solids 66 may be induced into the second chamber inlet 22 and mixed with motive fluid stream 32 is preferably at least about 10,000 kilograms per hour (kg/hr), more preferably at least 20,000 kg/hr, with at least 50,000 kg/hr being more preferred.

While the claimed subject matter has been described with respect to a limited number of embodiments, those skilled in the art, having benefit of this disclosure, will appreciate that other embodiments can be devised which do not depart from the scope of the claimed subject matter as disclosed herein. Accordingly, the scope of the claimed subject matter should be limited only by the attached claims.

What is claimed is:

1. A mixing apparatus for mixing solids and liquids comprising:

a mixing chamber defined within a plurality of sides radially arranged about a central axis, the mixing chamber comprising an eductor, the eductor comprising a first chamber inlet separated along the central axis from a chamber outlet by a frusta conical venturi throat arranged coaxial with a central axis, wherein the diameter of the venturi throat increases from the first chamber inlet to the chamber outlet;

the first chamber inlet radially arranged about the central axis and having an inlet diameter;

the chamber outlet radially arranged about the central axis and having an outlet diameter which is greater than the inlet diameter;

the eductor further comprising a second chamber inlet disposed through an outer wall of the venturi throat, and located between the first chamber inlet and the chamber outlet;

the second chamber inlet being in fluid communication with the first chamber inlet and the chamber outlet; and the second chamber inlet radially arranged about a second chamber inlet axis oriented perpendicular to the central axis, the second chamber inlet having a plurality of second inlet opening diameters, each determined perpendicular to the central axis at the point at which the second chamber inlet intersects with an outer wall of the venturi throat, wherein the second inlet diameters is less than the diameter of the venturi throat at the points at which the second chamber inlet intersects with the venturi throat and the second inlet opening diameters increase in a direction away from the central axis.

2. The mixing apparatus of claim 1, wherein the second inlet opening comprises a frustoconical opening coaxial with the second chamber inlet axis.

3. The mixing apparatus of claim 1, further comprising a hopper operable to provide a plurality of solid particles to the mixing chamber through the second chamber inlet.

4. The mixing apparatus of claim 1, further comprising a turbulence chamber coaxially arranged about the central axis, wherein the turbulence chamber is in fluid communication with the chamber outlet.

5. The mixing apparatus of claim 4 further comprising a diffuser radially arranged about the central axis, wherein the diffuser is in fluid communication with the turbulence chamber, the diffuser comprising a diffuser inlet in fluid communication with a diffuser throat, in fluid communication with a diffuser outlet.

6. The mixing apparatus of claim 5, wherein the diffuser comprises a circular cross-section determined perpendicular to the central axis.

7. The mixing apparatus of claim 6, wherein the diffuser is coaxial with the central axis.

8. The mixing apparatus of claim 5, wherein the diffuser inlet comprises a frustoconical opening coaxial with the central axis, wherein the diameter of the diffuser inlet increases continuously along the central axis in a direction toward the diffuser throat at a rate proportional to a diffuser inlet angle determined relative to the central axis.

9. The mixing apparatus of claim 8, wherein the diffuser throat has a circular cross-section determined perpendicular to the central axis and has a constant inner diameter from the diffuser inlet to the diffuser outlet.

10. The mixing apparatus of claim 9, wherein the diffuser outlet comprises a frustoconical opening coaxial with the central axis, wherein the diameter of the diffuser outlet decreases continuously along the central axis in a direction away from the diffuser throat at a rate proportional to a diffuser outlet angle determined relative to the central axis.

11. The mixing apparatus of claim 10, wherein the diffuser inlet angle is less than the diffuser outlet angle.

12. The mixing apparatus of claim 5, wherein a diameter of the diffuser inlet is greater than a diameter of the diffuser outlet.

13. The mixing apparatus of claim 1, wherein the inlet diameter is greater than or equal to about 2 cm.

14. The mixing apparatus of claim 1, wherein the outlet diameter is greater than or equal to about 4.5 cm.

15. The mixing apparatus of claim 1, wherein the mixing apparatus comprises a polymeric resin.

16. The mixing apparatus of claim 15, wherein the mixing apparatus comprises a polyurethane resin having a Shore D hardness of greater than or equal to about 50.

17. A method of mixing a plurality of solid particles and a liquid comprising:

introducing the liquid as a motive fluid into a first chamber inlet of a mixing apparatus, introducing the plurality of solid particles into a second chamber inlet of the mixing apparatus, and contacting the solid particles with the liquid to produce a mixture of the solid particles and the liquid, the mixing apparatus comprising:

a mixing chamber defined within a plurality of sides radially arranged about a central axis, the mixing chamber comprising an eductor, the eductor comprising the first chamber inlet separated along the central axis from a chamber outlet by a frusta conical venturi throat arranged coaxial with a central axis, wherein the diameter of the venturi throat increases from the first chamber inlet to the chamber outlet;

the first chamber inlet radially arranged about the central axis and having an inlet diameter;

the chamber outlet radially arranged about the central axis and having an outlet diameter which is greater than the inlet diameter;

the eductor further comprising a second chamber inlet disposed through an outer wall of the venturi throat, and located between the first chamber inlet and the chamber outlet;

the second chamber inlet being in fluid communication with the first chamber inlet and the chamber outlet; and the second chamber inlet radially arranged about a second chamber inlet axis oriented perpendicular to the central axis, the second chamber inlet having a plurality of second inlet opening diameters, each determined perpendicular to the central axis at the point at which the second chamber inlet intersects with an outer wall of the venturi throat, wherein the second inlet diameter is less than the diameter of the venturi throat at the points at which the second chamber inlet intersects with the venturi throat and the second inlet opening diameters increase in a direction away from the central axis.

18. The method of claim 17, further comprising the steps of directing the combination of the motive fluid and the solid from the chamber outlet into a turbulence chamber, into a diffuser, or a combination thereof, to further mix the motive fluid with the solids.

19. The method of claim 17, wherein the motive fluid comprises water, wherein the motive fluid is introduced into the first chamber inlet at a flow rate greater than or equal to about 100 liters per minute, and wherein the plurality of solids are introduced into the second chamber inlet at a rate of greater than or equal to about 10,000 kilograms per hour.

20. The method of claim 17, wherein the mixture of the solid particles and the liquid is suitable for use as a drilling mud.

* * * * *